US009738477B1

(12) United States Patent
Kolb et al.

(10) Patent No.: US 9,738,477 B1
(45) Date of Patent: Aug. 22, 2017

(54) PACKAGE OF FLAT MATERIAL AND METHOD OF MAKING A PACKAGE OF FLAT MATERIAL

(71) Applicant: Proton Products, Inc., Huntingdon, PA (US)

(72) Inventors: Jerel Jay Kolb, North Huntingdon, PA (US); Mike Vidra, Export, PA (US)

(73) Assignee: Proton Products, Inc., Huntingdon, PA (US)

( * ) Notice: Subject to any disclaimer, the term of this patent is extended or adjusted under 35 U.S.C. 154(b) by 120 days.

(21) Appl. No.: 14/694,335

(22) Filed: Apr. 23, 2015

(51) Int. Cl.

| | |
|---|---|
| ***B65H 18/28*** | (2006.01) |
| ***B32B 37/14*** | (2006.01) |
| ***B32B 37/18*** | (2006.01) |
| ***B65D 85/672*** | (2006.01) |
| ***B65H 75/06*** | (2006.01) |
| ***B65H 18/08*** | (2006.01) |

(52) U.S. Cl.
CPC ..... *B65H 18/28* (2013.01); *B32B 37/142* (2013.01); *B32B 37/18* (2013.01); *B65D 85/672* (2013.01); *B65H 18/08* (2013.01); *B65H 75/06* (2013.01); *B32B 2405/00* (2013.01)

(58) Field of Classification Search
CPC ..... B65H 18/28; B65H 75/06; B32B 37/18; B32B 37/142
See application file for complete search history.

(56) References Cited

U.S. PATENT DOCUMENTS

| | | | | |
|---|---|---|---|---|
| 3,006,464 | A | 10/1961 | Snell | |
| 3,144,934 | A | 8/1964 | Schultz | |
| 3,286,828 | A * | 11/1966 | Yovanovich | B65H 75/06 242/222 |
| 3,780,855 | A * | 12/1973 | McLeod | B65H 75/06 206/389 |
| 3,958,778 | A * | 5/1976 | Lawson | B65H 75/06 242/222 |
| 3,967,800 | A * | 7/1976 | Firstenberg | B65H 75/06 242/222 |
| 4,909,388 | A | 3/1990 | Watanabe | |
| 5,269,421 | A * | 12/1993 | Taylor | B65D 85/672 206/411 |
| 6,077,577 | A | 6/2000 | Spatorico et al. | |
| 6,224,705 | B1 | 5/2001 | Kao et al. | |
| 6,383,590 | B1 * | 5/2002 | Kao | B32B 1/00 242/160.1 |
| 6,500,290 | B1 | 12/2002 | Kao et al. | |
| 7,731,120 | B1 * | 6/2010 | Robshaw | B65H 75/06 242/610.2 |
| 8,251,208 | B2 | 8/2012 | Morrissey et al. | |
| 2006/0090837 | A1 | 5/2006 | Kao et al. | |
| 2008/0060748 | A1 | 3/2008 | Kao | |

FOREIGN PATENT DOCUMENTS

| | | |
|---|---|---|
| EP | 1045016 B1 | 4/2004 |

* cited by examiner

*Primary Examiner* — Sang Kim
(74) *Attorney, Agent, or Firm* — Cohen & Grigsby, P.C.

(57) ABSTRACT

A package of flat material in a flat profile and a method for making the package. Flat material is wound around a core having hollow channels that are coupled by engagement with extruding pins from a member. The member is mounted on an axis that rotates, causing the member to rotate. The rotation winds the flat material onto the core. The final package of flat material has a flat profile, which may be a convenient shape for storage in small and confined places.

23 Claims, 3 Drawing Sheets

PACKAGE OF FLAT MATERIAL AND METHOD OF MAKING A PACKAGE OF FLAT MATERIAL

CROSS-REFERENCE TO RELATED APPLICATION

Not Applicable

STATEMENT REGARDING FEDERALLY SPONSORED RESEARCH OR DEVELOPMENT

Not Applicable

INCORPORATION BY REFERENCE OF MATERIALS SUBMITTED ON A COMPACT DISC

Not Applicable

BACKGROUND OF THE INVENTION

Field of the Invention

The invention relates to a product of multi-layered flat material and a process for its manufacture.

Problem Presented and Description of the Related Art

Flat materials such as pressure sensitive adhesive tape, plastic film, cloth, metal foil, composite material film, or paper are commonly provided in a roll form, wound around a cylindrical inner core, which is often made of paper or plastic. Materials manufactured in this manner are usually bulky and not sufficiently compact to place in the pocket of one's clothing or to fit into a confined space.

The demand for convenient handing and storing of products have led to manufacturing these flat materials in a flat profile, instead of a circular roll profile. This modification adds convenience for carrying in a pocket, bag, or pack and creates a product that is easy to store and transport.

Processes to manufacture flat materials in a flat profile have been identified in the prior art. For example, U.S. Pat. No. 3,006,464, U.S. Pat. No. 6,224,705, U.S. Pat. Application Publication No. US20080060748, U.S. Pat. No. 6,500,290, and E.U. Pat. No. EP 1,045,016 disclose processes for producing flat material on a cylindrical roll that is subsequently flattened or compressed to create the desired flat shaped profile. U.S. Pat. No. 6,077,577 discloses package of wrapping flat material on a flat core, but the core has multiple parts that may require preassembly prior to wrapping the flat material. U.S. Pat. No. 5,269,421 discloses a package of wrapped flat material on a flat solid core.

Flattening an existing circular roll of tape to produce a flat-shaped package often results in a rebound of the package shape. The flattened package will gradually return to its larger, more circular shape and become less flattened. Manufacturing processes where the core is constructed with multiple pieces additionally adds complexity and cost to the manufacturing operation.

The present invention provides a low cost manufacturing process to wrap a flat material directly onto a flat core, thus creating a package of flat wrapped material that retains its flat profile that is suitable for carrying and storing.

BRIEF SUMMARY OF THE INVENTION

The invention encompasses a package of flat wrapped material in a flat profile and a process for making it.

The package of flat wrapped material in a flat profile may include a core having a length and a width, a plurality of hollow channels that traverse the core width, and a length of the flat material wrapped around the core.

The core may be made from substantially rigid material, for example, cardboard, plastic, or wood. The core may have a predetermined thickness which provides the desired core thickness for facilitating the winding of the flat material on the core. The flat material can be adhesive tape, plastic film, cloth, metal foil, composite material film, plastic, non-woven, or paper.

The method for making the package of flat material includes: providing a core having a length and a width and a plurality of hollow channels that traverse the width of the core; providing a member having a plurality of pins extending from the member where the core is engaged with the pins such that the pins become situated in the hollow channels of the core; attaching the flat material onto the core; and rotating the member causing the flat material to wrap around the core making a package of flat wrapped material. The pins can be cylindrical or rectangular. The member may be coupled to a motor drive shaft for rotating the member. Rotation of the member causes the flat material to wrap around the length of the core, resulting in a package of flat wrapped material.

BRIEF DESCRIPTION OF THE SEVERAL VIEWS OF THE DRAWINGS

Further aspects of the present disclosure together with additional features and advantages will be apparent from the following description of embodiments of the disclosure, which are shown in the accompanying drawing figures wherein.

DETAILED DESCRIPTION OF THE INVENTION

It is to be understood that the description of the invention has been simplified to illustrate elements that are relevant for an understanding of the invention, while eliminating, for purposes of clarity, other elements that may be well known.

The invention encompasses a package of flat wrapped material in a flat profile 2 as well as a process for manufacturing said flat wrapped material in a flat profile 2.

Figure 1:
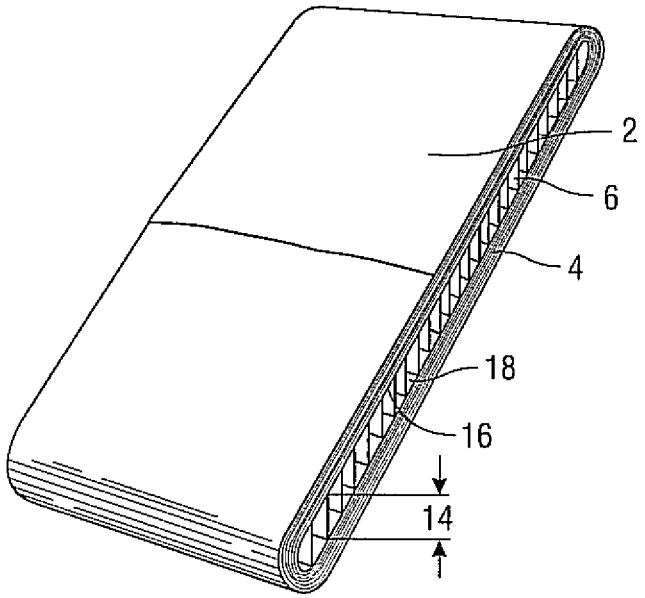
FIG. 1 shows an isometric view of a package of flat wrapped material.
Figure 2A:
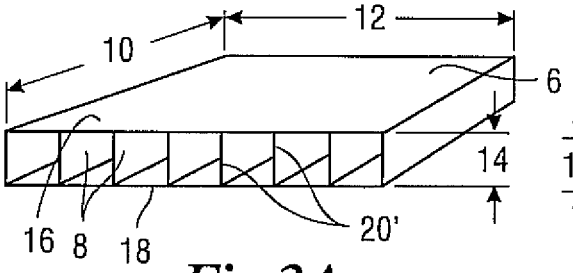
FIG. 2A shows a sectional isometric view of a core having hollow channels that traverse the core width.
Figure 2B:
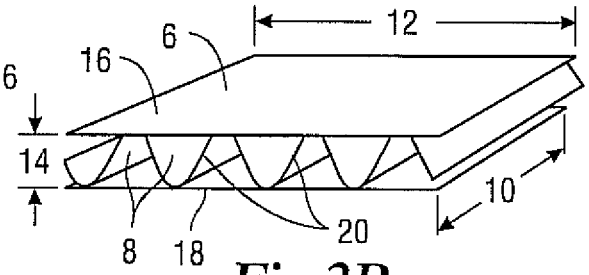
FIG. 2B shows an isometric view of a core as an alternate to the hollow channels seen in FIG. 2A.
Figure 3:
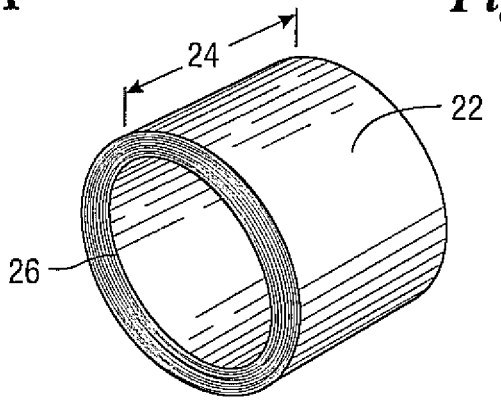
FIG. 3 shows an isometric view of flat material packaged around a circular core.

One aspect of the present invention is the package of flat wrapped material in a flat profile 2, shown in FIG. 1, that includes the following components, each shown in further detail in FIGS. 2A, 2B, and 3:

a. a core 6 having a plurality of hollow channels 8 that traverse the core width 10; and b. flat material in a plurality of layers 4 wound around the core 6.

The package of flat material includes a core 6 having a plurality of hollow channels 8 that traverse the core width 10. The core 6 may be a rectangular shape which, in addition to a core width 10, also has a core length 12 and a core thickness 14. The core 6 is a single piece of material having a top surface 16 and a bottom surface 18. The top surface of the core 16 and bottom surface of the core 18 are connected by structures 20 that create hollow channels 8 that traverse the core width 10 (as shown in FIGS. 2A and 2B). The structures 20 may be angled 20 or perpendicular 20'. The core 6 may be made from sufficiently rigid materials, for example, plastic, cardboard, or wood.

The package of flat material in a flat profile includes a flat material 22 wound around a core 6 such that the flat material 22 exists in a plurality of layers 4. The flat material 22 may be, for example, adhesive tape, plastic film, cloth, metal foil, composite material film, paper, or other substantially flat material. The flat material has a width 24. One example of a flat material is shown in FIG. 3. In this example, the flat material is packaged on a circular inner core 26. In a particularly useful embodiment of the invention, the flat material 22 is adhesive material with a width of the flat material 24 substantially identical to the core width 10.

In some embodiments, the core length 12, core width 10, and core thickness 14 may be determined by the size and weight of the flat material 22 to be wound. In other embodiments, the core length 12, core width 10, and core thickness 14 may be determined to create a final product with a size suitable for storage in a particularly small spaces, for example, a shirt pocket, glove box, or backpack. In particularly useful embodiments of the present invention, the final product may be produced using a core length 12 of 4.5 inches, a core width 10 of 2 inches, and core thickness 14 of 0.1 inches with the width of the flat material 24 being about 2 inches. The core length 12, core width 10, and core thickness 14 may be varied depending on the application and desired look of the final product.

Figure 4:
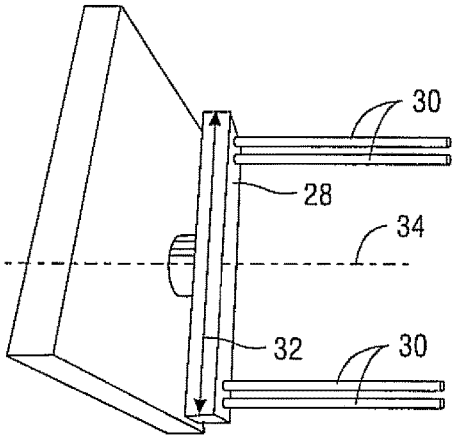
FIG. 4 shows a top isometric view of a member, which is on an axis allowing rotation, and has pins that extend outward.
Figure 5:
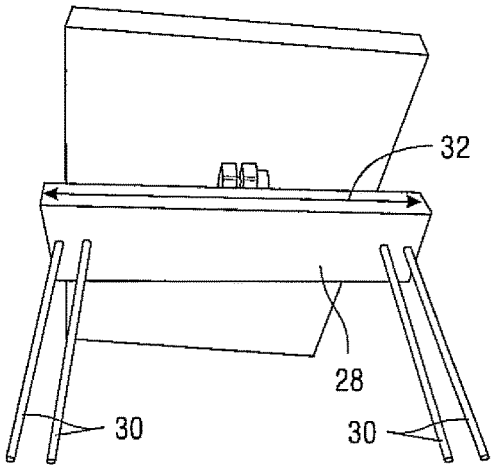
FIG. 5 shows a side isometric view of the member shown in FIG. 4.
Figure 6:
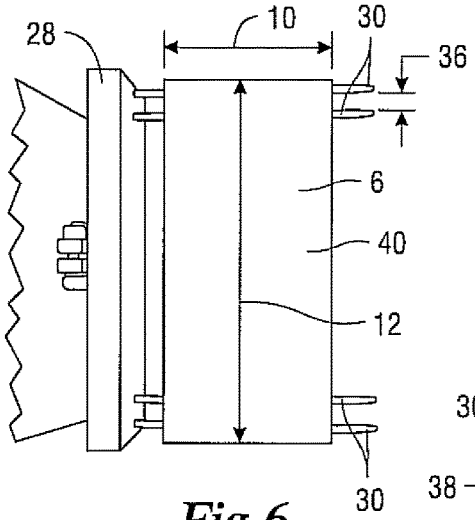
FIG. 6 shows a top isometric view of a core coupled to a member, achieved by moving the core relative to the pins such that the extending pins become situated within the hollow channels of the core.
Figure 7:
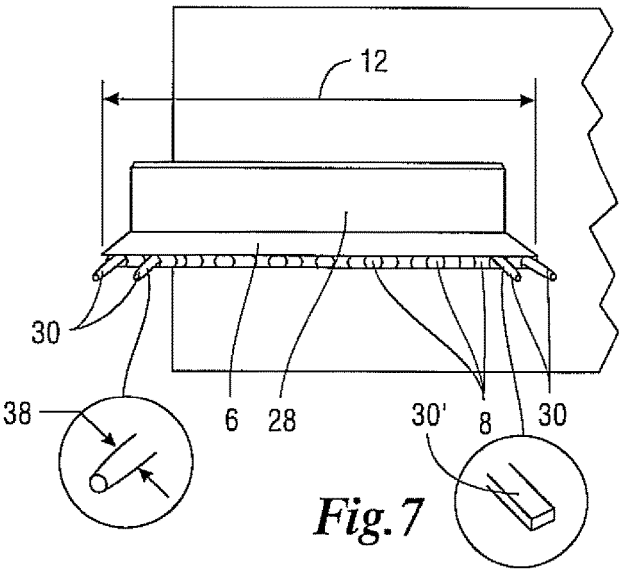
FIG. 7 shows a side isometric view of the core coupled to the member, achieved by moving the core relative to the pins such that the extending pins become situated within the hollow channels of the core.
Figure 10:
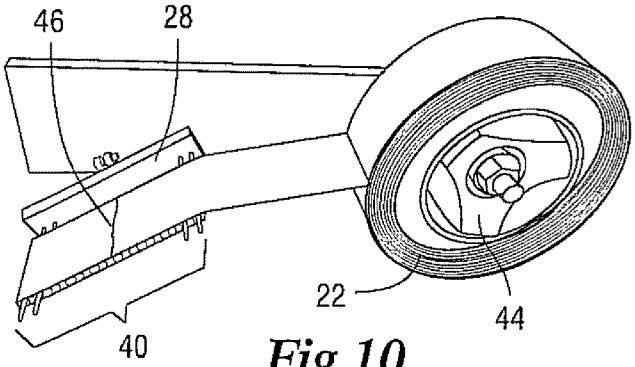
FIG. 10 shows a side isometric view of the coupled or engaged pins with the core, showing an example of how flat material mounted on an unwind roll holder may be attached to the core by the leading edge of the flat material.
Figure 11:
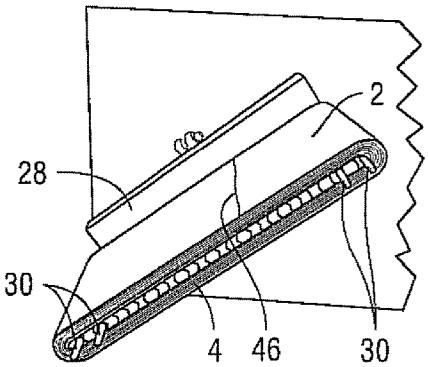
FIG. 11 shows a side isometric view of the package of flat wrapped material in a flat profile on the winding machine, where a flat material in a plurality of layers is wrapped onto the core.

The invention provides a process for manufacturing the flat wrapped material in a flat profile 2 that may be accomplished by the following steps:

a. providing a core 6 as described previously;

b. providing a member 28 having extending pins 30 (see FIGS. 4 and 5);

c. coupling the member 28 to the core 6 by moving the core relative to the pins such that the extending pins 30, 30' become situated within the hollow channels 8 of the core 6 (see FIGS. 6 and 7);

d. providing a length of flat material 22;

e. attaching the flat material 22 onto the core 6 (see FIGS. 9 and 10); and f. rotating the member 28 causing the core 6 to rotate and wrap the flat material 22 around the core 6 to a desired length making a package of flat wrapped material (See FIG. 11)

According to the above disclosure, a core 6, which has the characteristics as described previously above, is provided.

Next, a member 28 having extending pins 30 is provided. The extending pins may be cylindrical 30 or rectangular 30'. The member 28 has a length 32. The member 28 may be made from any structurally rigid material, for example, metal, plastic, or wood. The member 28 is mounted on an axis 34 which is perpendicular to the length of the member 32 and allows the member to rotate on the axis 34. As shown in FIG. 4, the extending pins 30 are secured to the member 28 and may be positioned in-line with each other. The number of extending pins 30, the spacing of the extending pins 36, and the thickness of the extending pins 38 may be determined such that the extending pins 30 may be inserted into two or more of the hollow channels 8 of the core 6. The number of extending pins 30, the spacing of the extending pins 36, and the thickness of the extending pins 38 may also be determined so as to provide enough rigidity to the core 6 to wind the flat material 22 around the core 6.

Next, the member 28 is coupled to the core 6 by moving the core relative to the pins such that the extending pins 30 become situated in the hollow channels 8 of the core 6, creating an engagement of the pins 30 with the core 6. In this arrangement, the extending pins 30 transverse the core 6 through the hollow channels 8 and may be perpendicular to the core length 12. An example of the engaged pins and core 40 on a member 28 is illustrated in FIGS. 6 and 7.

Figure 8:
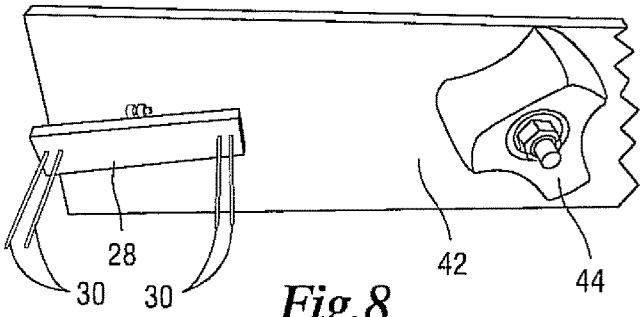
FIG. 8 shows a side isometric view of an example of a winding machine on which the package of flat wrapped material is in a flat profile. Components of this winding machine include an unwind roll holder and a member with protruding pins.

The member 28 with extending pins 30 mounted on an axis 34 may be incorporated into a machine to facilitate manufacture of the final package of flat material in a flat profile 2. One example of a suitable machine is the winding machine 42 shown in FIG. 8. The machine shown in this particular example includes an unwind roll holder 44 on which the flat material 22 packaged on a circular inner core 26 (as exemplified in FIG. 3) may be mounted.

Next, a length of flat material 22 is provided. This flat material 22 may be, for example, adhesive tape, plastic film, cloth, metal foil, composite material film, paper, or other substantially flat material. In particularly useful embodiments of the invention, the width of the flat material 24 is substantially equal to the core width 10.

Figure 9:
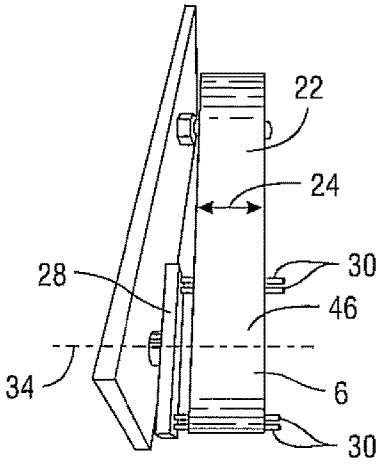
FIG. 9 shows a top isometric view of the coupled or engaged pins with the core, showing an example of how flat material mounted on an unwind roll holder may be attached to the core by a leading edge of the flat material.

The engaged pins and core 40 provides a base on which flat material 22 may be wound to create a flat material in a plurality of layers 4. The flat material 22 is next attached to the core 6. For adhesive-based flat material 22, the flat material may be secured directly onto the core 6 by directly adhering the leading edge of the flat material 22 to the bottom surface of the core 18 or top surface of the core 16. For non-adhesive based flat materials, the flat material 22 can be secured to the core 6 by an auxiliary adhesive source, for example, by taping or gluing the leading edge of the flat material 22 to the top surface of the core 16 or the bottom surface of the core 18. The flat material 22 may be adhered such that a flat plane of the flat material 22 is parallel with the top surface of the core 16 or bottom surface of the core 18 and such that the core width 10 and the width of the flat material 24 are substantially aligned. Exemplary illustrations of the attachment of adhesive flat material 22 to a plastic core 6 mounted on extending pins 30 (creating the engaged pins and core 40) are shown in FIGS. 9 and 10. In these particular examples, the adhesive flat material 22 is mounted nearby on an unwind roll roller 44 which allows the flat material 22 with adhesive properties mounted on a circular inner core 26 to easily be unwound off of the circular inner core 26 of the flat material 22 and onto the core 6 of the invention.

Next, the member 28 is rotated about the axis 34 causing the core 6 to also rotate and wind the flat material 22 around the core 6, creating a flat material in a plurality of layers 4 around the core 6, as shown in FIG. 11. The member 28 may be rotated by a variety of means, for example, by hand or with a motor. The winding action may be stopped when a sufficient amount of flat material 22 is wound around the core 6 to create the desired final product. After the winding is complete, the core 6 may be removed from the member 28 by withdrawing the package of flat wrapped material in a flat profile 2 off the extending pins 30, yielding a package of flat wrapped material in a flat profile 2 shown in FIG. 1.

Figure 12:
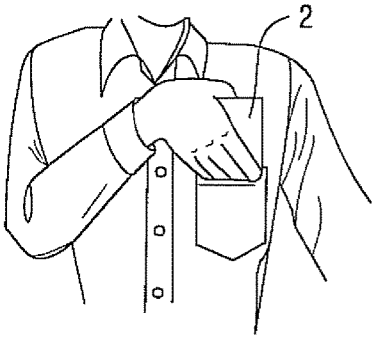
FIG. 12 shows a package of the flat material of the invention being placed into a shirt pocket.

In particularly useful embodiments of the present invention, the final product is the package of flat wrapped material in a flat profile 2 which is of suitable size and shape such that it fits into a shirt pocket, as illustrated in FIG. 12.

Various changes could be made in the above construction and method without departing from the scope of the invention as defined in the claims below. It is intended that all matter contained in the above description as shown in the accompanying drawings shall be interpreted as illustrative and not as a limitation.

We claim:

1. A package for a flat material, the package comprising:

a. a rigid core having a length and a width, top and bottom surfaces, and a plurality of structures separating the top and bottom surfaces that traverse the width of the core and are perpendicular to the length of the core, the plurality of structures creating a plurality of hollow channels for inserting a plurality of pins, wherein the rigid core is formed from a single piece of material; and b. a length of the flat material wrapped around the length of the core, wherein the perpendicular orientation of the plurality of structures to the length of the core provides stability and rigidity to maintain a uniform separation between the top and bottom surfaces of the core.

2. The package of flat material as recited in claim 1, wherein the material of the core is selected from the group consisting of cardboard and plastic.

3. The package of flat material as recited in claim 1, wherein the material of the core is of a predetermined thickness to provide a desired core thickness for facilitating wrapping of the flat material on the core.

4. The package of flat material as recited in claim 1, wherein the flat material is selected from the group consisting of adhesive tape, plastic film, cloth, metal, foil, composite material film, plastic, non-woven, and paper.

5. A method for making a package of flat material comprising:

a. providing a member having a plurality of pins extending from the member b. providing a rigid core having a length and a width, top and bottom surfaces, and a plurality of structures separating the top and bottom surfaces that traverse the width of the core and are perpendicular to the length of the core, the plurality of structures creating a plurality of hollow channels for inserting the plurality of pins, wherein the rigid core is formed from a single piece of material, and wherein the perpendicular orientation of the plurality of structures to the length of the core provides stability and rigidity to maintain a uniform separation between the top and bottom surfaces of the core;

c. engaging the plurality of pins within the plurality of hollow channels of the core;

d. providing a length of the flat material;

e. attaching an end of the length of the flat material onto the core; and f. rotating the member causing the flat material to wrap around the length of the core making a package of flat wrapped material.

6. The method for making a package of flat material as recited in claim 5, where the pins are cylindrical.

7. The method for making a package of flat material as recited in claim 5, where the pins are rectangular.

8. The method for making a package of flat material as recited in claim 5, where the member is coupled to a motor drive shaft for rotating the member.

9. A package of flat material, the package comprising:

a rigid, rectangular core having a length defined by opposing ends and a width defined by opposing sides, wherein the core is formed from a single piece of material and comprises two surfaces positioned substantially parallel to one another and connected by a plurality of structures that traverse the width of the core and are perpendicular the length of the core, wherein the plurality of structures form a plurality of transverse hollow channels between the two surfaces which are perpendicular to length of the core and which provide for insertion of a plurality of pins;

a length of a flat material wrapped in overlapping relation about the length of the core so that opposing ends of the core are covered by the flat material and opposing sides of the core remain exposed, the length of the flat material forming a plurality of layers of the flat material, wherein the perpendicular orientation of the plurality of structures to the length of the core provides stability and rigidity to maintain a uniform separation between the two surfaces of the core.

10. The package of flat material according to claim 9, wherein a width of the flat material is approximately the same as the width of the core.

11. The package of flat material according to claim 10, wherein the width of the flat material is about 2 inches.

12. The package of flat material of claim 9, wherein the material of the core comprises a cardboard material or a plastic material.

13. The package of flat material according to claim 9, wherein the material of the core comprises a rigid plastic material.

14. The package of flat material according to claim 9, wherein the plurality of structures that traverse the width of the core are substantially perpendicular to the two surfaces.

15. The package of flat material according to claim 14, wherein a profile of the plurality of transverse hollow channels is substantially square.

16. The package of flat material according to claim 14, wherein the transverse hollow channels have a diameter of about 0.1 inches.

17. The package of flat material according to claim 9, wherein the plurality of structures that traverse the width of the core are angled relative to the two surfaces.

18. The package of flat material according to claim 9, wherein the flat material is selected from the group consisting of adhesive tape, plastic film, cloth, metal, foil, composite material film, plastic, non-woven, and paper.

19. The package of flat material according to claim 9, wherein the flat material comprises a pressure sensitive adhesive tape.

20. The package of flat material according to claim 9, wherein the core has a thickness of about 0.1 inches.

21. The package of flat material of claim 9, wherein a section along the length of the core has a compressive strength of at least 10 in-lbs.

22. The package of flat material of claim 21, wherein the section is 0.18 inches wide or greater.

23. The package of flat material of claim 1, wherein a section along the length of the core has a compressive strength of at least 10 in-lbs, wherein the section is 0.18 inches wide or greater.

* * * * *